US010421311B2

(12) United States Patent
Mullen

(10) Patent No.: US 10,421,311 B2
(45) Date of Patent: Sep. 24, 2019

(54) WRITING INSTRUMENT HOLDER FOR HATS

(71) Applicant: Gerard Anthony Mullen, Glassboro, NJ (US)

(72) Inventor: Gerard Anthony Mullen, Glassboro, NJ (US)

( * ) Notice: Subject to any disclaimer, the term of this patent is extended or adjusted under 35 U.S.C. 154(b) by 0 days.

(21) Appl. No.: 15/997,268

(22) Filed: Jun. 4, 2018

(65) Prior Publication Data

US 2019/0001737 A1 Jan. 3, 2019

Related U.S. Application Data

(60) Provisional application No. 62/481,329, filed on Apr. 4, 2017.

(51) Int. Cl.

| | |
|---|---|
| ***B43K 23/00*** | (2006.01) |
| ***A42B 1/24*** | (2006.01) |
| ***A45F 5/02*** | (2006.01) |

(52) U.S. Cl.

CPC ..... *B43K 23/001* (2013.01); *A42B 1/24* (2013.01); *A45F 5/02* (2013.01); *A45F 2005/023* (2013.01); *A45F 2200/0566* (2013.01)

(58) Field of Classification Search

CPC ..... A45F 5/02; A42B 1/24; B43K 23/001
See application file for complete search history.

(56) References Cited

U.S. PATENT DOCUMENTS

| | | | | | |
|---|---|---|---|---|---|
| 2,297,806 | A * | 10/1942 | Smith | B43K 23/002 | 131/256 |
| 2,644,212 | A * | 7/1953 | Markowitz | B43K 23/001 | 223/109 A |
| 4,852,221 | A * | 8/1989 | Antonucci | B43K 23/001 | 24/10 R |
| 5,066,154 | A * | 11/1991 | Renaud | A42B 3/04 | 24/10 R |
| 5,449,242 | A * | 9/1995 | Salamone | B43K 23/001 | 24/10 R |
| 5,813,786 | A * | 9/1998 | Fraenkel | B43K 23/001 | 24/10 R |
| 5,867,874 | A * | 2/1999 | Simpson | A42B 1/24 | 24/10 R |
| 7,018,037 | B1 * | 3/2006 | Jouver, III | G02C 11/00 | 24/10 R |
| 7,137,151 | B2 * | 11/2006 | Keech | A42B 1/24 | 2/209.13 |
| 8,235,262 | B1 * | 8/2012 | Sakdol | A42B 3/04 | 224/183 |
| 2004/0237261 | A1 * | 12/2004 | Rouse | B43K 23/012 | 24/10 R |
| 2004/0237262 | A1 * | 12/2004 | Arnone | B43K 23/002 | 24/10 R |

(Continued)

*Primary Examiner* — Jason W San
(74) *Attorney, Agent, or Firm* — Dunlap Bennett & Ludwig PLLC

(57) ABSTRACT

A writing instrument holder includes a base with a connector configured to connect the base to a hat. A first magnetic material is coupled to the base. A writing instrument sleeve is configured to wrap around a writing instrument and includes a second magnetic material. The first magnetic material is attracted to the second magnetic material. When the writing instrument sleeve is wrapped around the writing instrument, the writing instrument releasably secures to the base.

7 Claims, 4 Drawing Sheets

(56) References Cited

U.S. PATENT DOCUMENTS

| | | | | |
|---|---|---|---|---|
| 2005/0108857 | A1* | 5/2005 | Wartian | A42B 1/24 24/10 R |
| 2005/0223525 | A1* | 10/2005 | Wartian | A42B 1/24 24/3.12 |
| 2006/0282989 | A1* | 12/2006 | Dietz | A45C 11/34 24/10 R |
| 2008/0240840 | A1* | 10/2008 | Huang | B43K 23/12 401/131 |
| 2014/0331388 | A1* | 11/2014 | Nunan | A45F 5/02 2/244 |

* cited by examiner

WRITING INSTRUMENT HOLDER FOR HATS

CROSS-REFERENCE TO RELATED APPLICATION

This application claims the benefit of priority of U.S. provisional application No. 62/481,329, filed Apr. 4, 2017, the contents of which are herein incorporated by reference.

BACKGROUND OF THE INVENTION

The present invention relates to writing instrument holders and, more particularly, to a writing instrument holder that attaches to hats.

Construction workers and other laborers constantly need a pencil to mark measurements and take other notes. Currently, laborers will carry pencils around with them in their pockets or on their ears. However, the pencils may be hard to reach when the laborer is climbing and the pencil is in the laborer's pocket. Further, the pencil may fall out of the laborer's ear, causing the inconvenience of having to retrieve the pencil.

As can be seen, there is a need for a writing instrument holder that attaches to a user's hat.

SUMMARY OF THE INVENTION

In one aspect of the present invention, a writing instrument holder comprises: a base comprising a connector configured to connect the base to a hat; a first magnetic material coupled to the base; and a writing instrument sleeve configured to wrap around a writing instrument and comprising a second magnetic material, wherein the first magnetic material is attracted to the second magnetic material.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
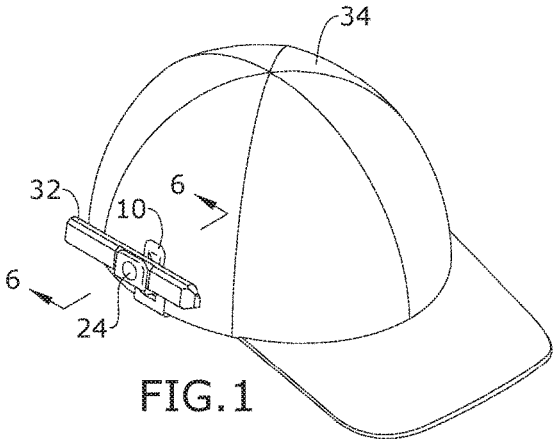
FIG. 1 is a perspective view of an embodiment of the present invention, shown in use.
Figure 2:
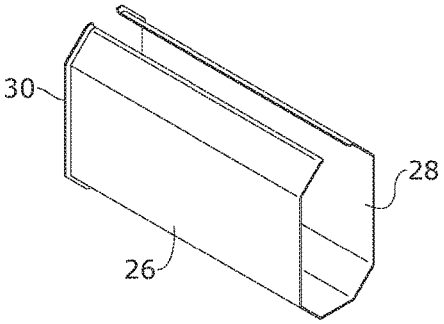
FIG. 2 is a perspective view of an embodiment of the present invention.
Figure 3:
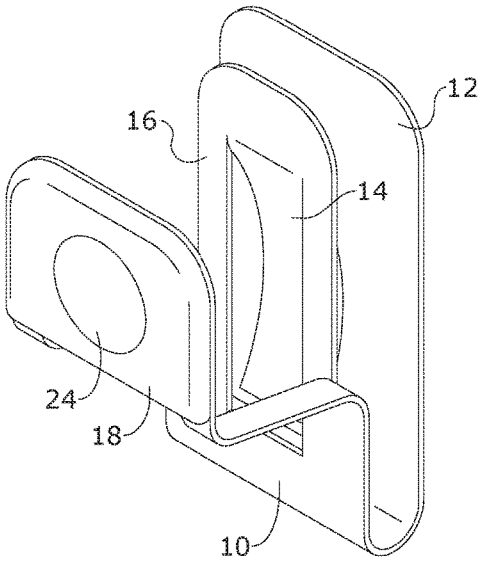
FIG. 3 is a front perspective view of an embodiment of a clip of the present invention.
Figure 4:
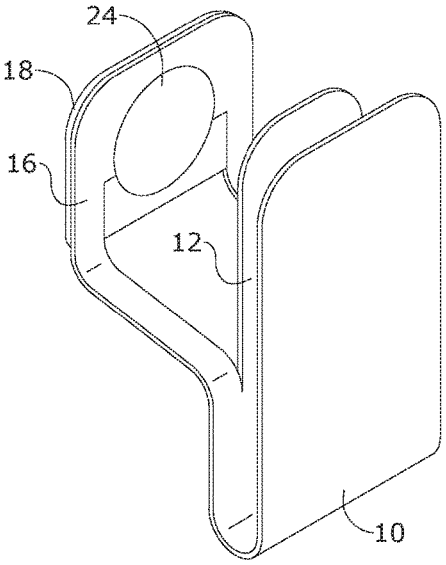
FIG. 4 is a rear perspective view of an embodiment of a clip of the present invention.
Figure 5:
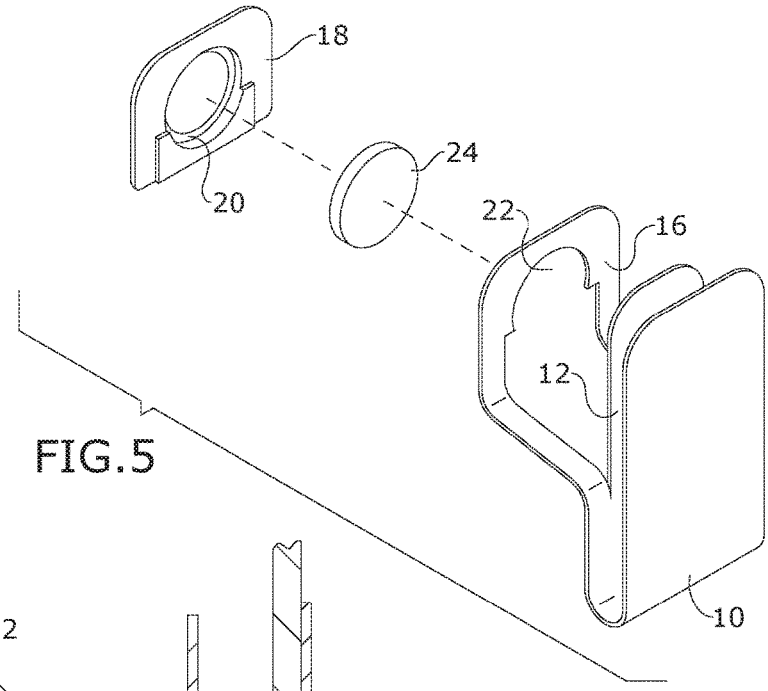
FIG. 5 is an exploded view of an embodiment of a clip of the present invention.
Figure 6:
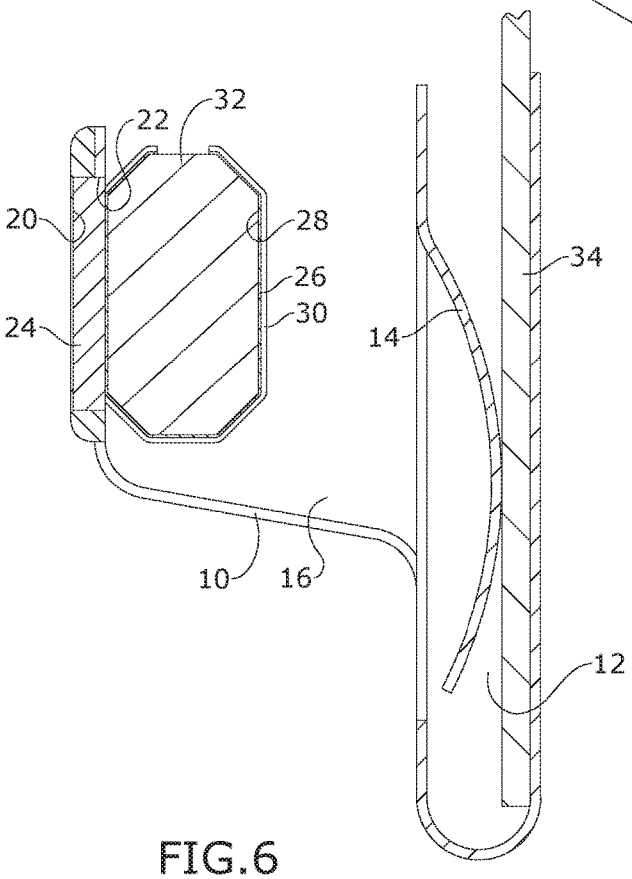
FIG. 6 is a section view of the present invention, taken along line 6-6 in FIG. 1.

Referring to FIGS. 1 through 6, a writing instrument holder includes a base 10 with a connector 14 configured to connect the base 10 to a hat 34. A first magnetic material 24 is coupled to the base 10. A writing instrument sleeve 26 is configured to wrap around a writing instrument 32 and includes a second magnetic material. The first magnetic material 24 is attracted to the second magnetic material. For example, the first magnetic material 24 is a magnet and the second magnetic material is a ferromagnetic metal. When the writing instrument sleeve 26 is wrapped around the writing instrument 32, the writing instrument 32 releasably secures to the base 10.

In certain embodiments, the connector 14 is a clip. The clip may include a U-shaped clip having a second sidewall connected to a first sidewall forming a second gap 12 therebetween. The first sidewall may include a spring bar 14 protruding into the second gap 12. A bottom edge of the hat 34 may fit within the second gap 12, and the spring bar 14 may apply pressure on the hat 34, thereby releasably securing the base 10 to the hat 34.

The base 10 may further include a writing instrument support sidewall 22. The first magnetic material 24 is coupled to the writing instrument support sidewall 22, and a first gap 16 is formed in between the writing instrument support sidewall 22 and the second sidewall. The writing instrument 32 with the writing instrument sleeve 26 may be secured to the base 10 within the first gap 16. In certain embodiments, the base 10 may include a magnet holder insert 18 with a magnet slot 20. The first magnetic material 24 is coupled within the magnet slot 20. The magnet holder insert 18 is then coupled to the writing instrument support sidewall 22.

The writing instrument sleeve 26 may be adapted to secure around any writing instrument 32, such as a pencil, a marker, and the like. In certain embodiments, the writing instrument sleeve 26 may be shaped to fit around a carpenters pencil. In such embodiments, the sleeve 26 is formed of a plurality of sidewalls connected together and forming a gap 28 therebetween. The plurality of sidewalls may be made of a flexible metal material and may include inner edges forming a gap therebetween. The writing instrument 32 form fits within the gap 28. The sleeve 26 may further include a lip 30 to prevent the writing instrument sleeve 26 from moving out of position when connected to the base 10.

Figure 7:
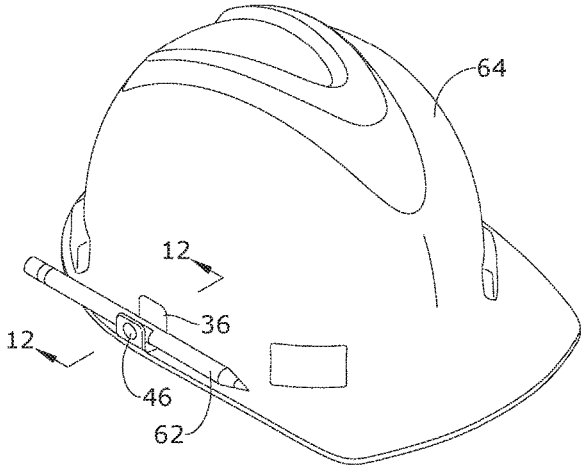
FIG. 7 is a perspective view of an embodiment of the present invention, shown in use.
Figure 8:
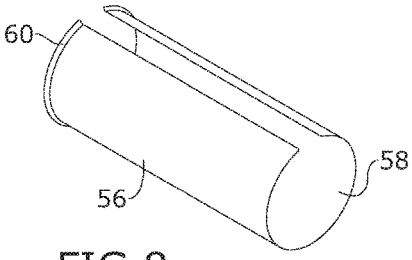
FIG. 8 is a perspective view of an embodiment of the present invention.
Figure 9:
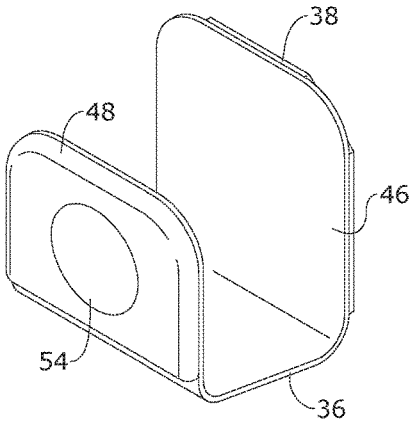
FIG. 9 is a front perspective view of an embodiment of a clip of the present invention.
Figure 10:
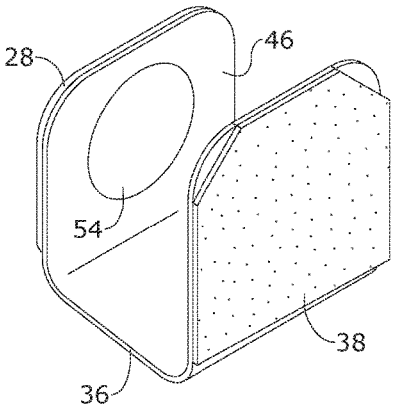
FIG. 10 is a rear perspective view of an embodiment of a clip of the present invention.
Figure 11:
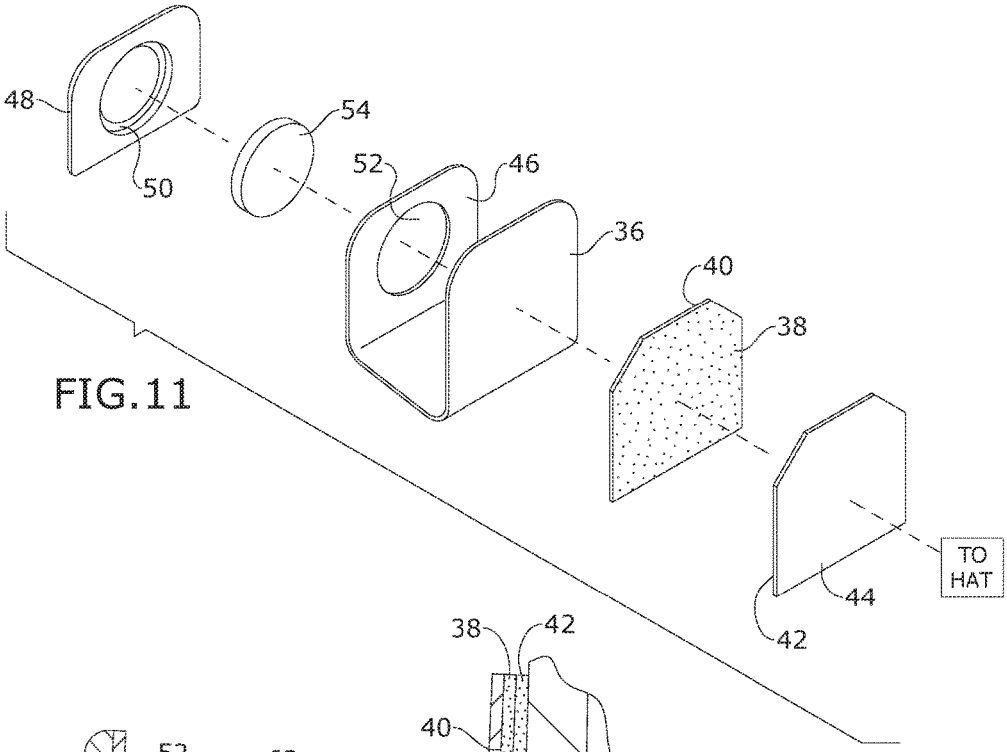
FIG. 11 is an exploded view of an embodiment of a clip of the present invention.
Figure 12:
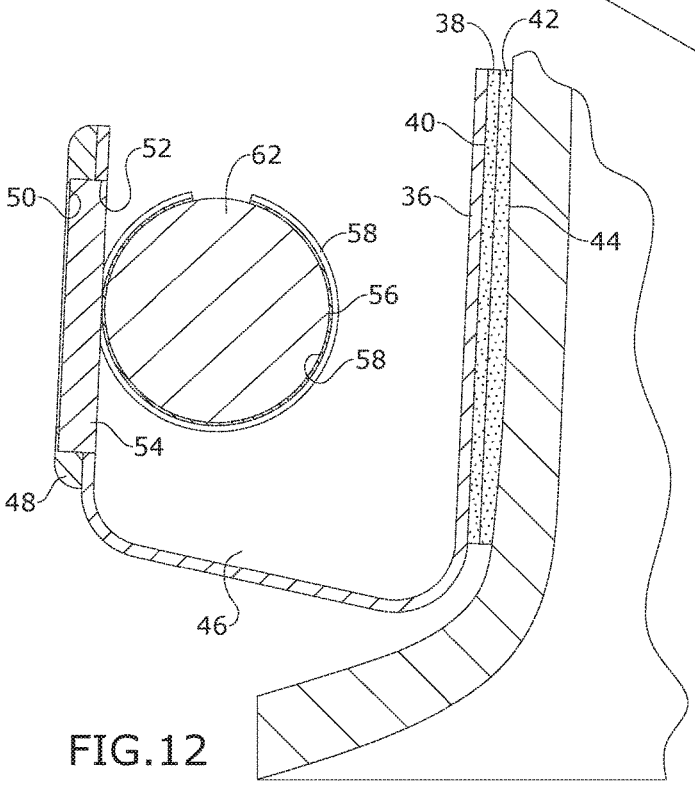
FIG. 12 is a section view of the present invention, taken along line 12-12 in FIG. 7.

Referring to FIGS. 7 through 12, a writing instrument holder includes a base 36 with a connector 38, 42 configured to connect the base 34 to a hard hat 64. A first magnetic material 54 is coupled to the base 36. A writing instrument sleeve 58 is configured to wrap around a writing instrument 62 and includes a second magnetic material. The first magnetic material 54 is attracted to the second magnetic material. For example, the first magnetic material 54 is a magnet and the second magnetic material is a ferromagnetic metal. When the writing instrument sleeve 58 is wrapped around the writing instrument 62, the writing instrument 62 releasably secures to the base 36.

The base 36 may include a U-shape having a first sidewall connected to a second sidewall forming a gap 46 therebetween. The first magnetic material 54 is coupled to the second sidewall and the connector 38, 42 is coupled to the first sidewall. In certain embodiments, the base 36 may include a magnet holder insert 48 with a magnet slot 50. The first magnetic material 54 is coupled within the magnet slot 50. The magnet holder insert 48 is then coupled to the writing instrument second sidewall.

In certain embodiments, the connector 38, 42 includes a hook fastener 38 and a loop fastener 42. One of the hook fastener 38 and the loop fastener 42 is adhered to an outer surface the first sidewall by an adhesive 40 and the other of the hook fastener 38 and the loop fastener 42 is adhered to the hard hat 64 by an adhesive 44. The hook fastener 38 releasably attaches to the loop fastener 42, thereby releasably attaching the base 36 to the hard hat 64.

The writing instrument sleeve 56 may be shaped to fit around a cylinder pencil or cylinder marker. In such embodiments, the sleeve 56 is formed of a rounded sidewall forming a gap 58 therebetween. The rounded sidewall may be made of a flexible metal material and may include inner edges forming a gap therebetween. The writing instrument 62 form fits within the gap 58. The writing instrument sleeve 56 may further include a lip 60 to prevent the writing instrument sleeve 56 from moving out of position when connected to the base 36.

It should be understood, of course, that the foregoing relates to exemplary embodiments of the invention and that modifications may be made without departing from the spirit and scope of the invention as set forth in the following claims.

What is claimed is:

1. A writing instrument holder comprising:

a base comprising a connector configured to connect the base to a hat, wherein the base further comprises a writing instrument support sidewall and a first sidewall, wherein a first gap is formed in between inner surfaces of the writing instrument support sidewall and the first sidewall;

a first magnetic material coupled to the base and disposed on the inner surface of the writing instrument support sidewall; and a writing instrument sleeve configured to wrap around a writing instrument and comprising a second magnetic material, wherein the writing instrument sleeve is releasably disposed within the first gap, the first magnetic material is attracted to the second magnetic material; and wherein the first magnetic material is a magnet and the second magnetic material is a ferromagnetic metal.

2. The writing instrument holder of claim 1, wherein the connector comprises a clip.

3. The writing instrument holder of claim 2, wherein the clip comprises a U-shaped clip comprising a second sidewall connected to the first sidewall forming a second gap therebetween.

4. The writing instrument holder of claim 3, wherein the first sidewall comprises a spring bar protruding into the second gap.

5. The writing instrument holder of claim 1, wherein the connector comprises a hook and loop fastener.

6. The writing instrument holder of claim 5, wherein one of the hook and loop fastener is adhered to the first sidewall and the other of the hook and loop fastener is adhered to a hat.

7. The writing instrument holder of claim 1, wherein the writing instrument sleeve further comprising a lip extending outwardly from at least one of a front edge and a rear edge.

* * * * *